US007986180B2

(12) United States Patent
Lee et al.

(10) Patent No.: US 7,986,180 B2
(45) Date of Patent: Jul. 26, 2011

(54) SEMICONDUCTOR MEMORY DEVICE HAVING INTERNAL VOLTAGE GENERATOR AND METHOD FOR DRIVING THE SAME

(75) Inventors: Kang-Seol Lee, Kyoungki-do (KR); Ji-Eun Jang, Kyoungki-do (KR)

(73) Assignee: Hynix Semiconductor Inc., Gyeonggi-do (KR)

( * ) Notice: Subject to any disclaimer, the term of this patent is extended or adjusted under 35 U.S.C. 154(b) by 0 days.

(21) Appl. No.: 12/500,305

(22) Filed: Jul. 9, 2009

(65) Prior Publication Data

US 2009/0267683 A1 Oct. 29, 2009

Related U.S. Application Data

(62) Division of application No. 11/714,194, filed on Mar. 6, 2007, now Pat. No. 7,576,596.

(30) Foreign Application Priority Data

Jun. 30, 2006 (KR) ..... 2006-0061409

(51) Int. Cl.
*G05F 1/10* (2006.01)

(52) U.S. Cl. ..... 327/540; 327/541; 327/543

(58) Field of Classification Search ..... 327/538, 327/540–541, 543; 323/315, 316
See application file for complete search history.

(56) References Cited

U.S. PATENT DOCUMENTS

| | | | | |
|---|---|---|---|---|
| 5,319,302 | A * | 6/1994 | Koshikawa et al. | 323/273 |
| 5,585,741 | A * | 12/1996 | Jordan | 326/30 |
| 6,194,887 | B1 * | 2/2001 | Tsukada | 323/315 |
| 6,300,749 | B1 * | 10/2001 | Castelli et al. | 323/273 |
| 6,791,308 | B2 * | 9/2004 | Shim | 323/314 |
| 7,576,596 | B2 * | 8/2009 | Lee et al. | 327/538 |
| 7,602,161 | B2 * | 10/2009 | McLeod | 323/273 |

* cited by examiner

*Primary Examiner* — Kenneth B. Wells
(74) *Attorney, Agent, or Firm* — IP & T Group LLP

(57) ABSTRACT

Embodiments of the present invention are directed to provide an internal voltage generator of a semiconductor memory device for generating a predetermined stable level of an internal voltage. The semiconductor memory device includes a control signal generator, an internal voltage generator and an internal voltage compensator. The control signal generator generates a reference signal and a compensating signal which are corresponding to voltage level of the reference signal. The internal voltage generator generates an internal voltage in response to the reference signal. The internal voltage compensator compensates the internal voltage in response to the compensating signal.

6 Claims, 6 Drawing Sheets

SEMICONDUCTOR MEMORY DEVICE HAVING INTERNAL VOLTAGE GENERATOR AND METHOD FOR DRIVING THE SAME

CROSS-REFERENCE TO RELATED APPLICATIONS

This application is a division of U.S. patent application Ser. No. 11/714,194 filed on Mar. 6, 2007, which claims priority of Korean patent application number 10-2006-0061409, filed in the Korean Patent Office on Jun. 30, 2006 and issued as U.S. Pat. No. 7,576,596, which is incorporated by reference in its entirety.

BACKGROUND OF THE INVENTION

The present invention relates to a semiconductor memory device; more particularly, it relates to an internal voltage generator of the semiconductor device.

A semiconductor memory device is an apparatus for storing a plurality of data and reading the stored data. For efficient data storage and reading, the semiconductor memory device generates a variety of internal voltages for internal operations, using supply and ground voltages provided from an external device. Examples of internal voltages include a core voltage for a data storage area and a driving voltage for a peripheral area. The core voltage is used in the data storage area where a plurality of input data are stored. The driving voltage for the peripheral area is used for outputting data stored in the data storage area to an external device and providing the input data into the data storage area. There are additional internal voltages which are higher than the supply voltage or lower than the ground voltage by predetermined amounts. Those internal voltages are used to efficiently control MOS transistors in the data storage area. An internal voltage higher than the supply voltage is usually provided to gates of MOS transistors in the data storage area. An internal voltage lower than the ground voltage is usually provided as a bulk voltage of MOS transistors in the data storage area. The semiconductor memory device is provided with internal voltage generators to provide the variety of internal voltages.

To perform storage and read operations, the semiconductor memory device receives row and column addresses and other corresponding commands. The semiconductor memory device reads data located in the cell corresponding to the input address or stores input data in the cell corresponding to the address. While accessing data is performed after the row and column addresses are input, the semiconductor memory device is in an active state. While waiting for commands and corresponding addresses for the data access, the semiconductor memory device is in a standby state. In a standby state, circuits awaiting external commands and addresses operate minimally. The semiconductor memory device includes internal voltage generators respectively operating in the active mode and the standby mode to minimize power consumption for generating the internal voltages.

Initially, when the supply voltage is provided to the semiconductor memory device, it takes some time for the level of the supply voltage to reach a predetermined level. If the semiconductor memory device starts operating with a supply voltage which is lower than the predetermined level, malfunctions can be caused. Accordingly, the semiconductor memory device requires a circuit for sensing a level of ascent of the supply voltage until the supply voltage becomes higher than the predetermined level. Such a circuit is generally called a power up circuit. A sensing signal generated by the power up circuit is called a power up signal. An internal voltage generator in the semiconductor memory device generates the internal voltage for the internal operation in response to the power up signal.

For a normal operation of the semiconductor memory device, it is important that the level of an internal voltage is maintained stably. As described above, an internal voltage generator in the semiconductor memory device generates an internal voltage for the internal operation in response to the power up signal. An internal voltage generator doesn't sense and maintain the level of its respective internal voltage after generating the internal voltage. Unless the level of the internal voltage is maintained to a predetermined level, malfunctions can be caused. Particularly, if the level of the internal voltage generated right after the power up signal is generated is changed, the semiconductor memory device may make an error in an initial operation.

SUMMARY OF THE INVENTION

Embodiments of the present invention are directed to providing an internal voltage generator of a semiconductor memory device for generating a predetermined stable level of internal voltage.

In accordance with an aspect of the present invention, the semiconductor memory device comprises a control signal generator for generating a reference signal and a compensating signal which corresponds to the voltage level of the reference signal, an internal voltage generator for generating an internal voltage in response to the reference signal and an internal voltage compensator for compensating the internal voltage in response to the compensating signal.

In accordance with another aspect of the present invention, a method for driving the semiconductor memory device comprises generating a first reference signal as a first voltage level and a second reference signal as a second voltage level which is lower than the first voltage level, generating an internal voltage in response to the first reference signal and compensating the internal voltage in response to the second reference signal.

In accordance with a further aspect of the present invention, a method for driving the semiconductor memory device comprises generating a first reference signal as a standard of generating an internal voltage, generating the internal voltage in response to the first reference signal, generating a supply voltage sensing signal when the level of a supply voltage is lower than a predetermined level and compensating the internal voltage is response to the supply voltage sensing signal.

In accordance with a further aspect of the present invention, the semiconductor memory device comprises a control signal generator for generating a reference signal and a compensating signal corresponding to the reference signal, an internal voltage generator for generating an internal voltage in response to the reference signal, an internal voltage sensor for sensing the internal voltage and generating an internal voltage sensing signal, a voltage comparator for comparing the compensating signal with the internal voltage sensing signal and a voltage compensator for compensating the internal voltage according to a comparing result.

DESCRIPTION OF SPECIFIC EMBODIMENTS

In accordance with the present invention, there is provided an internal voltage generator of a semiconductor memory device for stably generating an internal voltage necessary for internal operations. Even when the supply voltage is lower than a predetermined level, the semiconductor memory device according to the present invention can generate the internal voltage stably. Particularly, when the internal voltage is decreased, the internal voltage having a required level is stably maintained by compensating the decreased internal voltage conveniently. Accordingly, reliability of the semiconductor memory device according to the present invention is improved.

Hereinafter, the semiconductor memory device in accordance with the present invention will be described in detail referring to the accompanying drawings.

Figure 1:
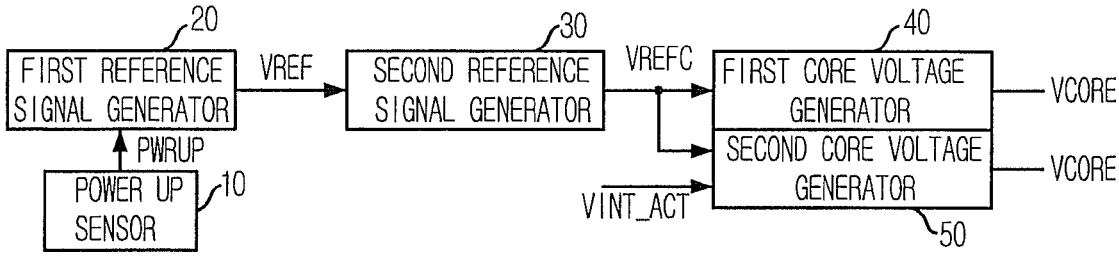
FIG. 1 is a block diagram showing a semiconductor memory device in accordance with the present invention.

FIG. 1 is a block diagram showing a semiconductor memory device in accordance with the present invention. The semiconductor memory device includes a power up sensor 10, a first reference signal generator 20, a second reference signal generator 30, a first core voltage generator 40 and a second core voltage generator 50. The power up sensor 10 senses a supply voltage and generates a power up signal PWRUP enabled according to the level of the supply voltage. The first reference signal generator 20 generates a first reference signal VREF in response to the power up signal PWRUP. The second reference signal generator 30 generates a second reference signal VREFC in response to the first reference signal VREF. The first core voltage generator 40 generates a core voltage VCORE in response to the second reference signal VREFC during a standby mode. The second core voltage generator 50 generates the core voltage VCORE in response to the second reference signal VREFC and an active signal VINT_ACT when in an active mode.

The active mode represents a period when address and command signals are input to the semiconductor memory device and operations corresponding to the input address and command signals are performed. The standby mode means a period when the semiconductor memory device waits for the address and command signals. Because different circuits supplied with the core voltage internally are enabled based on a standby or active mode, a plurality of core voltage generators are provided to generate an appropriate core voltage during each mode.

Figure 2:
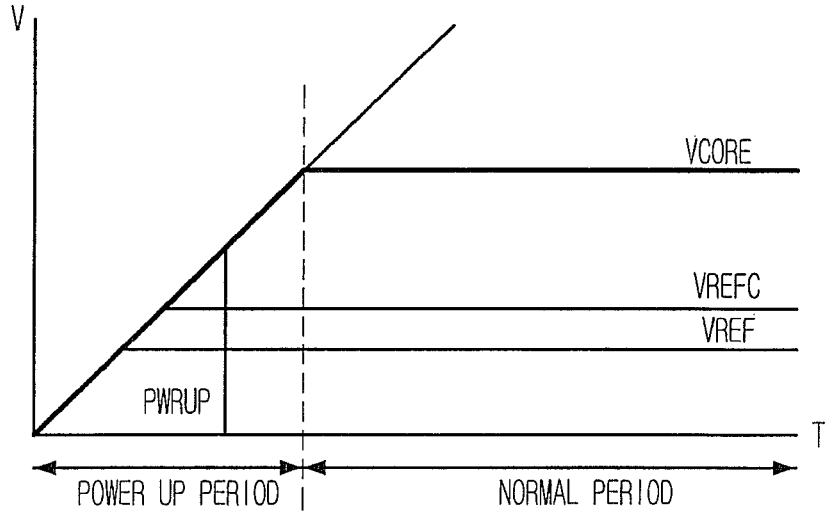
FIG. 2 is a signal timing diagram depicting an operation of the semiconductor memory device described in FIG. 1.

FIG. 2 is a signal timing diagram depicting an operation of the semiconductor memory device described in FIG. 1. A power up period is a period from a point of supplying the supply voltage to the semiconductor memory device to a point when the level of the supply voltage increases to a predetermined level. The power up signal PWRUP increases linearly according to an increase of the supply voltage in the power up period, and when the supply voltage is higher than a predetermined level, the power up signal PWRUP is disabled as a low level. The first reference signal VREF having a first voltage level is output by the first reference signal generator 20 in response to the power up signal PWRUP. The second reference signal VREFC having a second voltage level is output by the second reference signal generator 30 in response to the first reference signal VREF. The first and second core voltage generators 40 and 50 generate a predetermined level of core voltage VCORE in response to the second reference signal VREFC.

Figure 3:
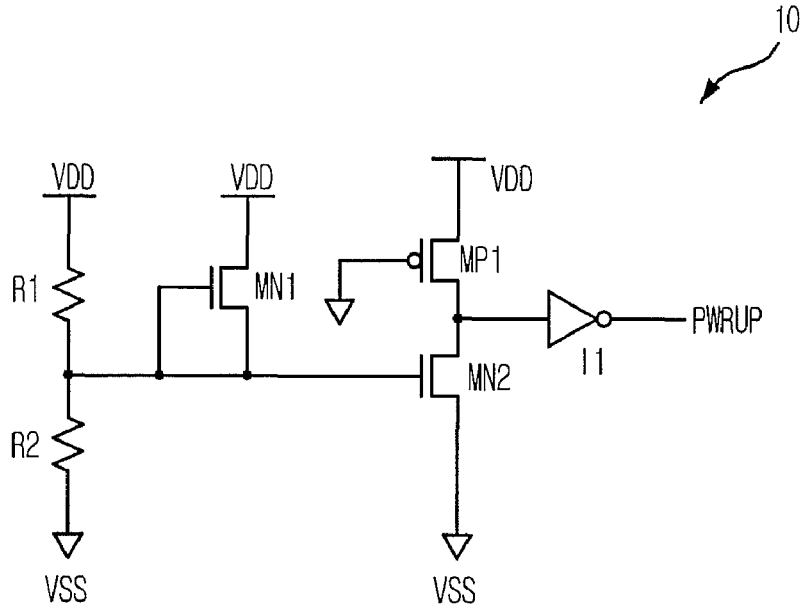
FIG. 3 is a schematic circuit diagram showing a power up sensor described in FIG. 1.

FIG. 3 is a schematic circuit diagram illustrating the power up sensor 10 described in FIG. 1. Initially, when the supply voltage VDD is provided to the semiconductor memory device, the supply voltage VDD increases from the level of the ground voltage. The supply voltage VDD is divided by resistors R1 and R2, and provided to a gate of a MOS transistor MN2. Meanwhile, a MOS transistor MP1 continues to be turned on. The supply voltage VDD, decreased in some degree by a turn-on resistance corresponding to the MOS transistor MP1, is input to an inverter I1. Accordingly, the power up signal PWRUP, i.e., an output of the inverter I1, is increased linearly as the supply voltage VDD rises. When the supply voltage VDD generated by the MOS transistor MP1 is equal to a predetermined level, the power up signal PWRUP is disabled to a ground voltage level.

Figure 4:
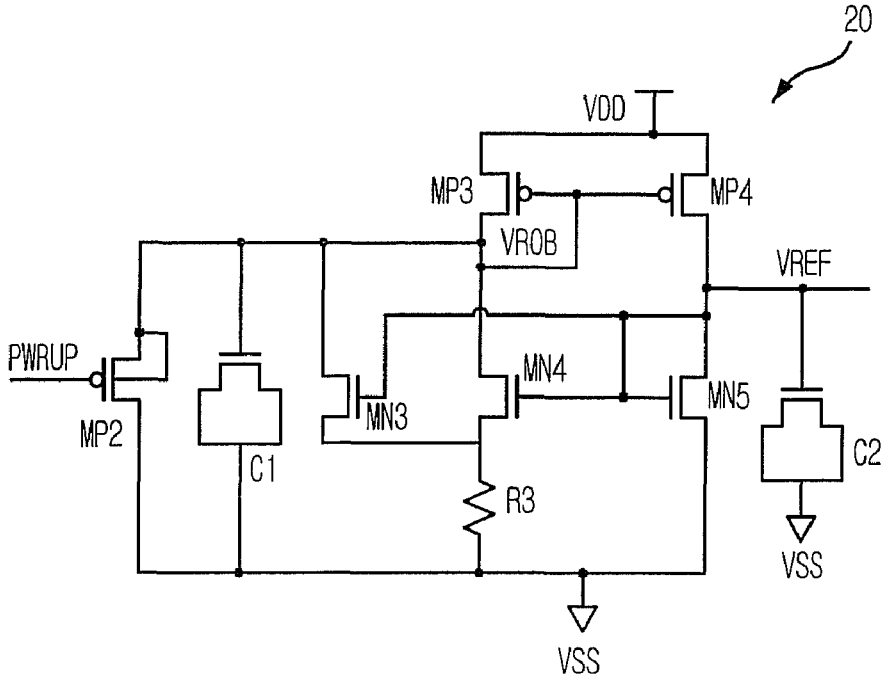
FIG. 4 is a schematic circuit diagram showing a first reference signal generator described in FIG. 1.

FIG. 4 is a schematic circuit diagram illustrating the first reference signal generator 20 described in FIG. 1. The first reference signal generator 20 generates the first reference signal VREF in response to the power up signal PWRUP. Particularly, the first reference signal generator 20 can generate the first reference signal VREF so as to be insensitive to circumstances such as process conditions, fluctuations of the supply voltage, and temperature at operation.

Figure 5:
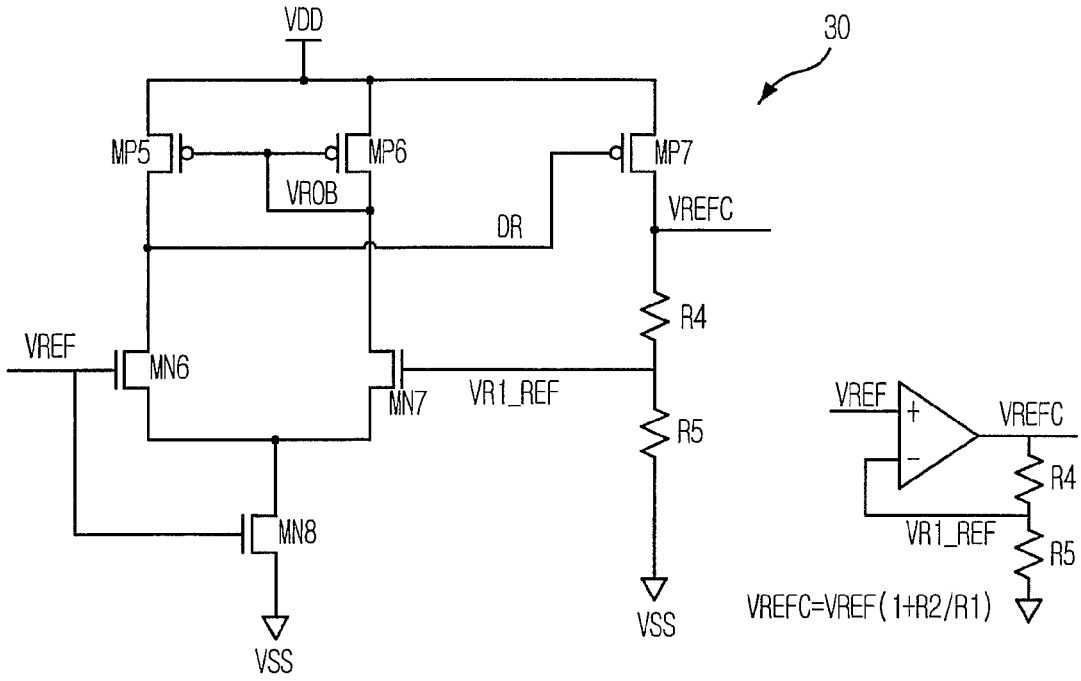
FIG. 5 is a schematic circuit diagram showing a second reference signal generator described in FIG. 1.

FIG. 5 is a schematic circuit diagram illustrating the second reference signal generator 30 described in FIG. 1. The second reference signal generator 30 generates the second reference signal VREFC in response to the first reference signal VREF. Comparing the first reference signal VREF with a first comparing signal VR1_REF, the second reference signal generator 30 increases the second reference signal VREFC when the first reference signal VREF is higher than the first comparing signal VR1_REF. When the first reference signal VREF is lower than the first comparing signal VR1_REF, the second reference signal VREFC is not increased. Accordingly, the level of the second reference signal VREFC is determined by a resistance ratio of the resistors R4 and R5 and the voltage level of the first reference signal VREF. The second reference signal generator 30 is also briefly embodied by an operational amplifier described in FIG. 5.

Figure 6:
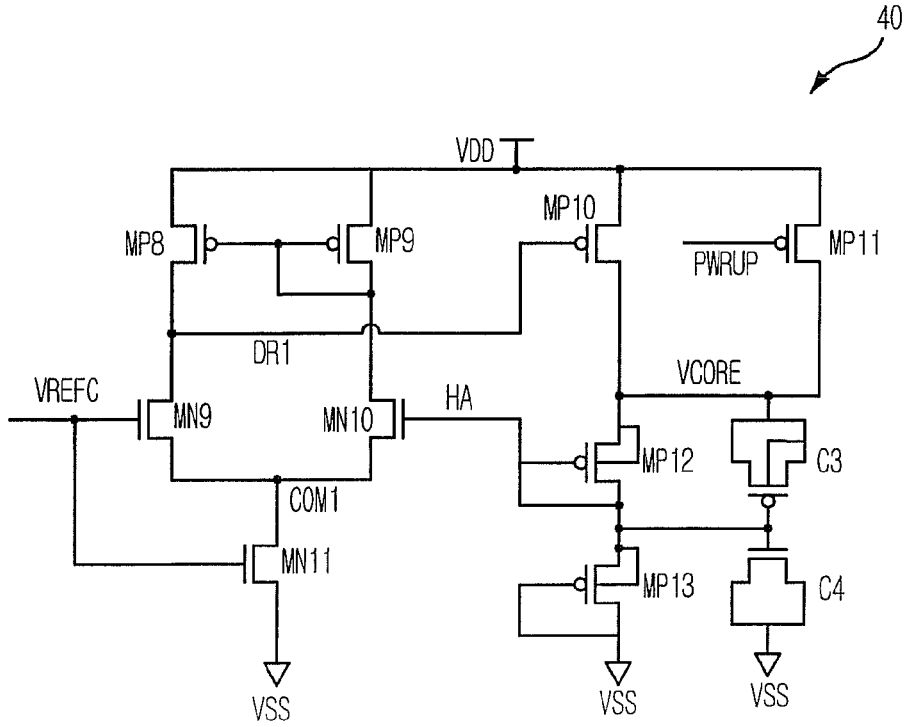
FIG. 6 is a schematic circuit diagram showing a first core voltage generator described in FIG. 1.

FIG. 6 is a schematic circuit diagram showing the first core voltage generator 40 described in FIG. 1. The first core voltage generator 40 outputs the core voltage VCORE in response to the second reference signal VREFC. Comparing a second comparing signal HA with the second reference signal VREFC, the first core voltage generator 40 increases the core voltage VCORE when the second reference signal VREFC is lower than the second comparing signal HA. When the second reference signal VREFC is higher than the second comparing signal HA, the core voltage VCORE is not increased. Capacitors C3 and C4 are there for maintaining the level of the core voltage VCORE. Diode-connected MOS transistors MP12 and MP13 divide the core voltage VCORE to generate the second comparing signal HA.

Figure 7:
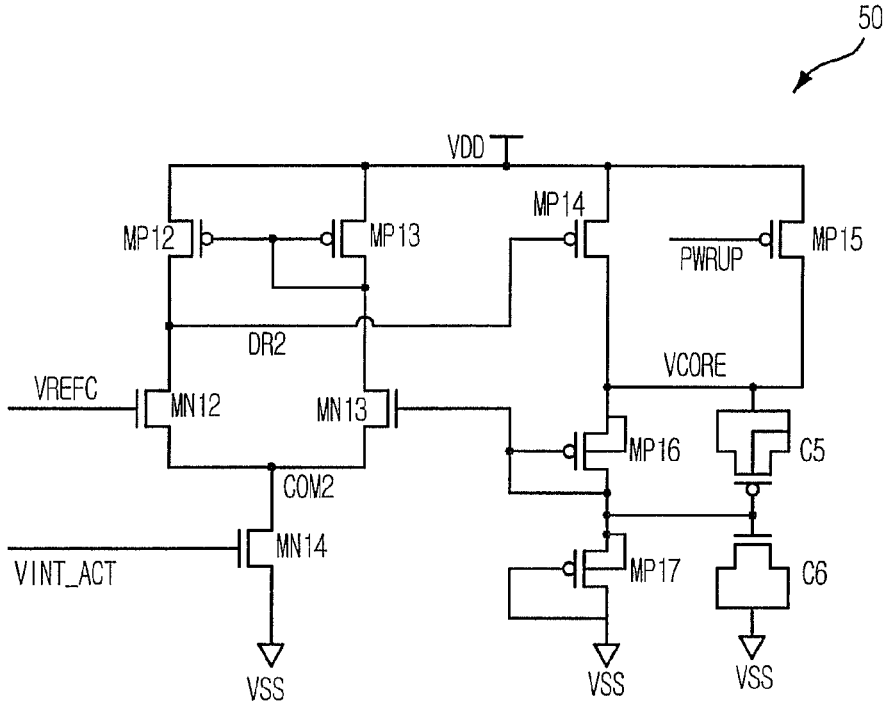
FIG. 7 is a schematic circuit diagram showing a second core voltage generator described in FIG. 6.

FIG. 7 is a schematic circuit diagram illustrating the second core voltage generator 50 described in FIG. 6. Operation of the second core voltage generator 50 is similar to that of the first core voltage generator 40. It differs in that the second core voltage generator 50 performs the operation for comparing voltages in response to the active signal VINT_ACT.

The semiconductor memory device according to an embodiment of the present invention generates the reference signal in response to the power up signal and the internal voltage in response to the reference signal. As technology matures, the semiconductor memory device should operate at higher speeds and reduce power consumption. For reducing the power consumption, it is typical that a lower level supply voltage is supplied to the semiconductor memory device. In the case where the supply voltage is decreased, it could be difficult to stably generate an internal voltage having a required level even by fine fluctuation of the reference signal.

In addition, the semiconductor memory device according to the first embodiment firstly generates the core voltage and outputs the core voltage. If the core voltage decreases, the semiconductor memory device does not have a sufficient ability for compensating the core voltage. However, in another embodiment of the present invention, there is provided a semiconductor memory device with a compensator for compensating the core voltage even when the core voltage decreases.

Figure 8:
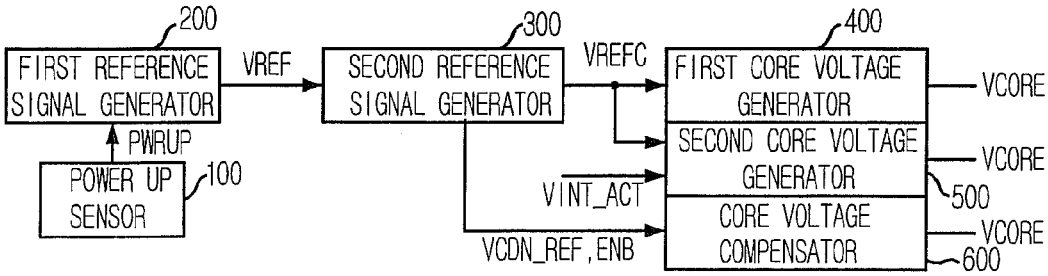
FIG. 8 is a block diagram showing a semiconductor memory device in accordance with another embodiment of the present invention.

FIG. 8 is a block diagram showing a semiconductor memory device in accordance with another embodiment of the present invention. The semiconductor memory device includes a power up sensor 100, a first reference signal generator 200, a second reference signal generator 300, a first core voltage generator 400, a second core voltage generator 500 and core voltage compensator 600. The power up sensor 100 senses a supply voltage to generate a power up signal PWRUP enabled according to the level of the supply voltage. The first reference signal generator 200 generates a first reference signal VREF in response to the power up signal PWRUP. The second reference signal generator 300 generates a second reference signal VREFC having a first voltage level and a compensating signal VCDN_REF having a second voltage level in response to the first reference signal VREF. The second voltage level is lower than the first voltage level by a predetermined level. The first core voltage generator 400 generates a core voltage VCORE in response to the second reference signal VREFC during a standby mode. The second core voltage generator 500 outputs the core voltage VCORE in response to the second reference signal VREFC and an active signal VINT_ACT during an active mode. The core voltage compensator 600 compensates the core voltage VCORE in response to the compensation signal VCDN_REF.

The internal voltage generator of the semiconductor memory device according to the present invention can be applied to generate a variety of internal voltages necessary to internal operations. Generating the core voltage will be described preponderantly.

Figure 9:
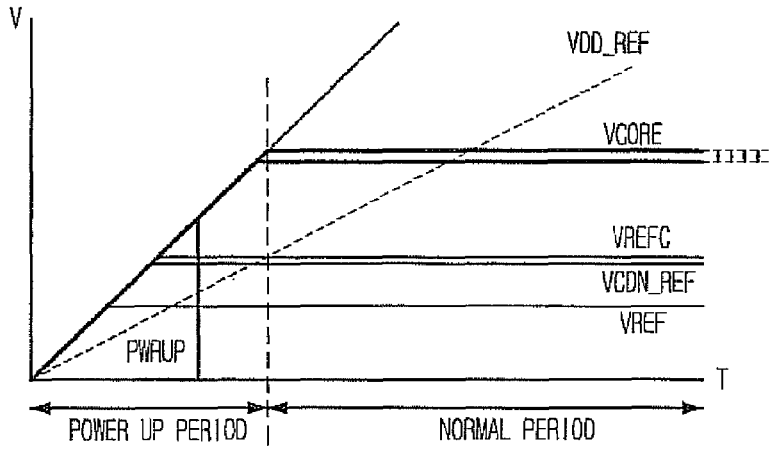
FIG. 9 is a signal timing diagram depicting an operation of the semiconductor memory device described in FIG. 8.

FIG. 9 is a signal timing diagram depicting an operation of the semiconductor memory device described in FIG. 8. The power up signal PWRUP is increased linearly during the power up period. When the supply voltage is higher than a predetermined level, the power up signal PWRUP is disabled as a low level. The first reference signal VREF is output by the first reference signal generator 200 in response to the power up signal PWRUP. The second reference signal VREFC is output by the second reference signal generator 300 in response to the first reference signal VREF. The first and second core voltage generators 400 and 500 generate a predetermined level of core voltage VCORE in response to the second reference signal VREFC respectively. In addition, the second reference signal generator 300 outputs a compensating signal VCDN_REF corresponding to the first and second reference signals VREF and VREFC. The core voltage compensator 600 can compensate a level of the core voltage VCORE stably according to a level of the compensating signal VCDN_REF.

Meanwhile, during the normal mode after the power up period has ended, the second reference signal generator 300 senses when the supply voltage falls below a predetermined level and generates a supply voltage sensing signal ENB. The second reference signal generator 300 outputs the supply voltage sensing signal ENB to the core voltage compensator 600. The core voltage compensator 600 compensates the core voltage VCORE in response to the supply voltage sensing signal ENB, in order to maintain the core voltage VCORE at a constant level.

First of all, the semiconductor memory device generates the core voltage VCORE by using the first core voltage generator 400. And then, comparing the compensating signal VCDN_REF with the core voltage sensing signal HALF, the semiconductor memory device compensates the core voltage VCORE by using the core voltage compensator 600. Moreover, the semiconductor memory device senses when the supply voltage decreases and generates the supply voltage sensing signal ENB. Thus, the semiconductor memory device maintains a voltage level of the core voltage.

Figure 10:
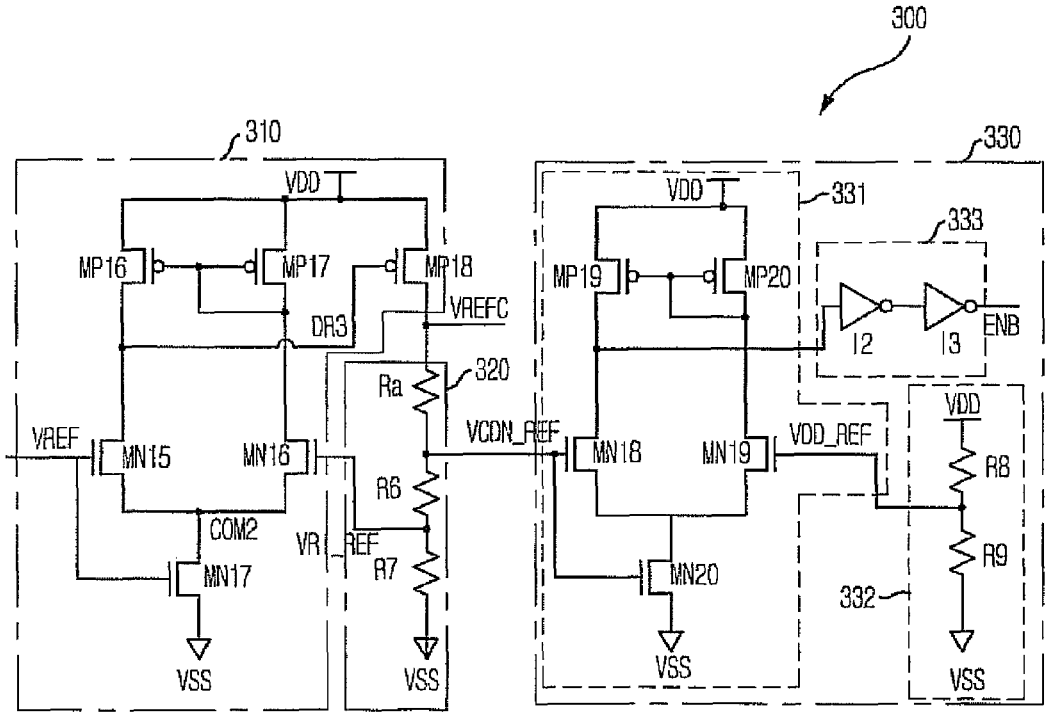
FIG. 10 is a schematic circuit diagram showing a second reference signal generator described in FIG. 8.

FIG. 10 is a schematic circuit diagram illustrating the second reference signal generator 300 described in FIG. 8. The second reference signal generator includes a reference signal generator 310, a compensating signal generator 320, and a voltage sensor 330.

The reference signal generator 310 compares a first comparing signal VR1_REF with the first reference signal VREF and selectively turns on a MOS transistor MP18 according to the comparing result. The voltage level of the second reference signal VREFC determined according to the MOS transistor MP18 is output to the first and second core voltage generators 400 and 500.

The compensating signal generator 320 generates the compensating signal VCDN_REF by decreasing the voltage level of the second reference signal VREFC by a predetermined level. The compensating signal generator 320 includes resistors Ra, R6 and R7 in series for dividing the voltage level of the second reference signal VREFC. The compensating signal VCDN_REF is generated at a node between the first and second resistors Ra and R6, and the first comparing signal VR1_REF is generated at a node between the second and third resistors R6 and R7.

The voltage sensor 330 senses the voltage level of the compensating signal VCDN_REF and generates the supply voltage sensing signal ENB to the core voltage compensator 600. The voltage sensor 330 includes a comparing signal generator 332, a comparator 331 and a sensing signal output unit 333.

The comparing signal generator 332 generates a second comparing signal VDD_REF by dividing the supply voltage. The comparing signal generator 332 includes resistors R8 and R9 in series between the supply voltage and a ground voltage. The second comparing signal VDD_REF is generated at a node between the fourth and fifth resistors R8 and R9.

The comparator 331 compares the compensating signal VCDN_REF with the second comparing signal VDD_REF. The comparator 331 includes MOS transistors. First and second MOS transistors MP19 and MP20 coupled to a supply voltage terminal constitute a current mirror. Third MOS transistor MN18 connected to the first MOS transistor MP19 receives the compensating signal VCDN_REF at its gate. Fourth MOS transistor MN19 connected to the second MOS transistor MP20 receives the second comparing signal VDD_REF at its gate. Fifth MOS transistor MN20 connected between the third and fourth MOS transistors MN18 and MN19 and a ground voltage terminal receives the compensating signal VCDN_REF at its gate. A result of comparing the second comparing signal VDD_REF with the compensating signal VCDN_REF, which is output from a common node of the first and third MOS transistors MP19 and MN18, is provided to the sensing signal output unit 333.

The sensing signal output unit 333 outputs the supply voltage sensing signal ENB according to the comparing result of the comparator 331. The sensing signal output unit 333 includes inverters I2 and I3. The first inverter I2 receives the comparing result, and the second inverter I3 inverts an output of the first inverter I2 to output the supply voltage sensing signal ENB to the core voltage compensator 600.

The operation of the second reference signal generator 300 shown in FIG. 10 is described below. Comparing the first reference signal VREF with the first comparing signal VR1_REF, the reference signal generator 310 outputs the second reference signal VREFC having a voltage level corresponding to the comparing result. The compensating signal generator 320 outputs the compensating signal VCDN_REF by decreasing a voltage level of the second reference signal VREFC with a resistance value of the first resistor Ra. The compensating signal generator 320 outputs the first comparing signal VR1_REF by decreasing a voltage level of the second reference signal VREFC with resistance values of the first and second resistors Ra and R6. Comparing the compensating signal VCDN_REF with the second comparing signal VDD_REF, the voltage sensor 330 outputs the supply voltage sensing signal ENB according to a comparing result.

Figure 11:
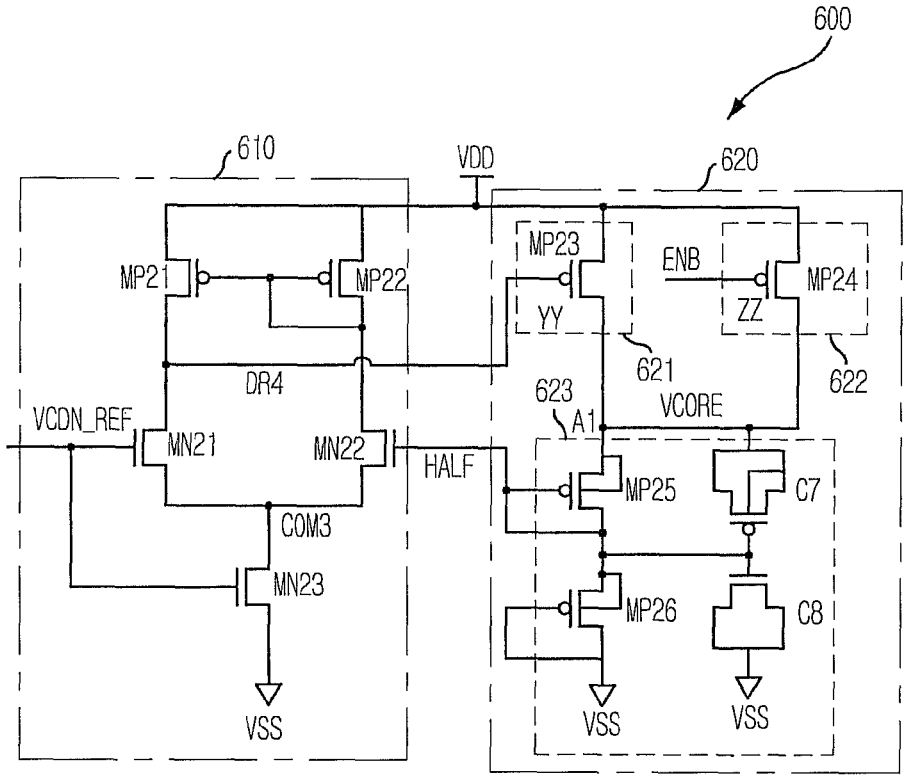
FIG. 11 is a schematic circuit diagram showing a core voltage compensator described in FIG. 8.

FIG. 11 is a schematic circuit diagram illustrating the core voltage compensator 600 described in FIG. 8. The core voltage compensator 600 compensates the core voltage VCORE in response to the compensating signal VCND_REF. The core voltage compensator 600 also compensates the core voltage VCORE in response to the supply voltage sensing signal ENB.

The core voltage compensator 600 includes a core voltage comparator 610, a first voltage compensator 621, a second voltage compensator 622, and a core voltage sensor 623. The core voltage comparator 610 compares the compensating signal VCDN_REF with a core voltage sensing signal HALF. The first voltage compensator 621 provides the supply voltage to a core voltage output node A1 in order to compensate the core voltage up to a predetermined level according to a comparing result of the core voltage comparator 610. The second voltage compensator 622 provides the supply voltage to the core voltage output node A1 in order to compensate the core voltage up to the predetermined level in response to the supply voltage sensing signal ENB. The core voltage sensor 623 outputs the core voltage sensing signal HALF to the core voltage comparator 610 by sensing the core voltage VCORE provided to the core voltage output node A1.

The core voltage comparator 610 includes MOS transistors. Sixth and seventh MOS transistors MP21 and MP22 coupled to the supply voltage terminal constitute a current mirror. Eighth MOS transistor MN21 connected to the sixth MOS transistor MP21 receives the compensating signal VCDN_REF at its gate. Ninth MOS transistor MN22 connected to the seventh MOS transistor MP22 receives the core voltage sensing signal HALF at its gate. Tenth MOS transistor MN23 connected between the eighth and ninth MOS transistors MN21 and MN22 and the ground voltage terminal receives the compensating signal VCDN_REF at its gate. The result of comparing the core voltage sensing signal HALF with the compensating signal VCDN_REF is output from a common node of the sixth and eighth MOS transistors MP21 and MN21.

The first voltage compensator 621 includes an eleventh MOS transistor MP23 connected between the supply voltage terminal and the core voltage output node A1, in order to compensate the core voltage VCORE according to the comparing result of the core voltage comparator 610. The second voltage compensator 622 includes a twelfth MOS transistor MP24 connected between the supply voltage terminal and the core voltage output node A1, in order to compensate the core voltage VCORE in response to the supply voltage sensing signal ENB.

The core voltage sensor 623 includes capacitors and diodes. First and second capacitors C7 and C8 are connected in series between the core voltage output node A1 and the ground voltage terminal. A first diode MP25 is connected to the core voltage output node A1 and a second diode MP26 is connected between the first diode MP25 and the ground voltage terminal. A common node of the first and second diodes MP25 and MP26 and a common node of the first and second capacitors C7 and C8 are coupled through which the core voltage sensing signal HALF is output to the core voltage comparator 610.

The operation of the core voltage compensator 600 shown in FIG. 10 is described below. The core voltage compensator 600 compares the voltage level of the compensating signal VCDN_REF with the core voltage VCORE. When the voltage level of the compensating signal VCDN_REF is higher than the voltage level of the core voltage sensing signal HALF, the core voltage compensator 600 compensates the core voltage VCORE by providing the supply voltage to the core voltage output node A1. In addition, when the level of the supply voltage becomes lower than a predetermined level, the inactivated supply voltage sensing signal ENB is input in the low logic level. And then, the second voltage compensator 622 is enabled and the core voltage VCOR is compensated.

Figure 12:
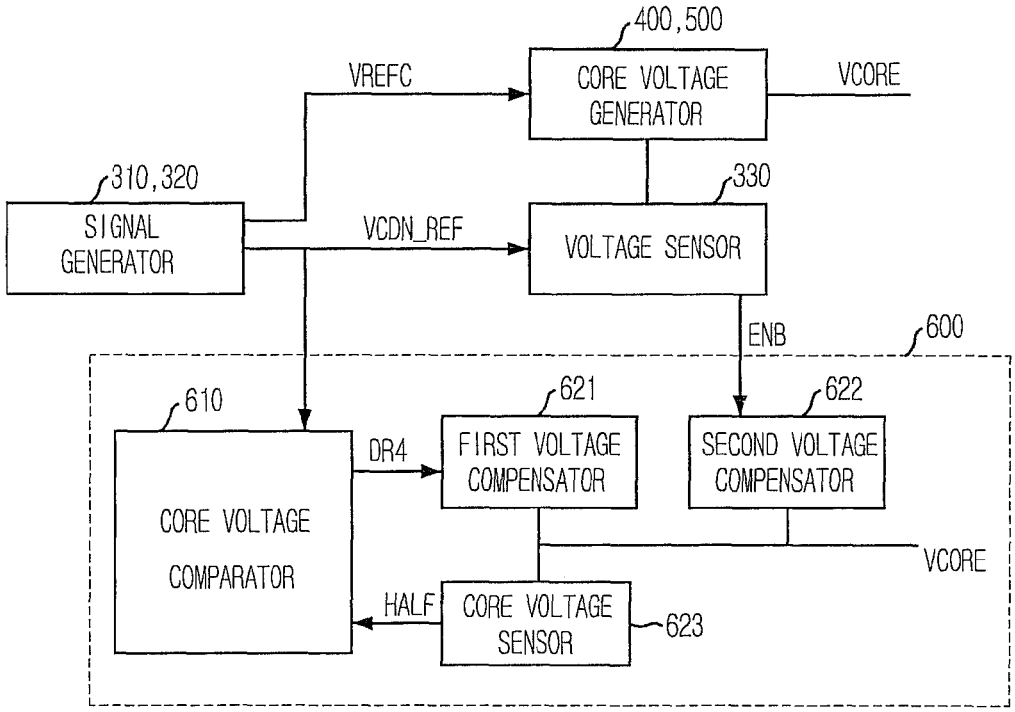
FIG. 12 is a block diagram showing technical features of the present invention.

FIG. 12 is a block diagram illustrating technical features of the present invention. For depicting features of internal circuits described in FIGS. 10 and 11, the block diagram is described with the similar drawing characters as those used in previous drawings.

While the present invention has been described with respect to the particular embodiments, it will be apparent to those skilled in the art that various changes and modifications may be made without departing from the spirit and scope of the invention as defined in the following claims.

What is claimed is:

1. A method for driving a semiconductor memory device, comprising:

generating a first reference signal having a first voltage level and a compensating signal having a second voltage level lower than the first voltage level by a predetermined level;

generating an internal voltage in response to the first reference signal;

comparing the compensating signal with a voltage derived from the internal voltage;

compensating the internal voltage based on the comparison result; and comparing the compensating signal with a comparing voltage to generate a supply voltage detection signal and changing a state of a transistor coupled between a power supply voltage and the internal voltage from a switched-off state to a switched-on state in response to the supply voltage detection signal to further compensate the internal voltage when the power supply voltage becomes lower than a first threshold level, wherein the comparing voltage is generated from the power supply voltage and the generating of the first reference signal and the compensating signal includes generating the first reference signal by dividing the power supply voltage and generating the compensating signal by dividing the first reference signal.

2. The method for driving the semiconductor memory device of claim 1, wherein the internal voltage includes one of a core voltage, a high level voltage and a low level voltage and wherein the high level voltage is higher than a power supply voltage by a predetermined level and the low level voltage is lower than a ground voltage by a predetermined level.

3. The method for driving the semiconductor memory device of claim 1, wherein the generating of the internal voltage includes:

generating the internal voltage corresponding to a standby mode during the standby mode; and generating the internal voltage corresponding to an active mode during the active mode.

4. A method for driving a semiconductor memory device, comprising:

generating a first reference signal;

generating an internal voltage in response to the first reference signal;

generating a power supply voltage sensing signal when the level of a power supply voltage is lower than a predetermined level;

generating a compensating signal by dividing the first reference signal;

comparing the compensating signal with a voltage derived from the internal voltage; and compensating the internal voltage in response to the comparison result and the supply voltage sensing signal;

comparing the compensating signal with a comparing voltage to generate a supply voltage detection signal and changing a state of a transistor coupled between the power supply voltage and the internal voltage from a switched-off state to a switched-on state in response to the supply voltage detection signal to further compensate the internal voltage when the power supply voltage becomes lower than a first threshold level, wherein the comparing voltage is generated from the power supply voltage and the generating of the first reference signal includes generating the first reference signal by dividing the power supply voltage.

5. The method for driving the semiconductor memory device of claim 4, wherein the internal voltage includes one of a core voltage, a high level voltage and a low level voltage and wherein the high level voltage is higher than the power supply voltage by a predetermined level and the low level voltage is lower than a ground voltage by a predetermined level.

6. The method for driving the semiconductor memory device of claim 4, wherein the generating of the internal voltage includes:

generating the internal voltage corresponding to a standby mode during the standby mode; and generating the internal voltage corresponding to an active mode during the active mode.

* * * * *